US009032744B2

(12) United States Patent
Miller

(10) Patent No.: US 9,032,744 B2
(45) Date of Patent: May 19, 2015

(54) ICE MAKER FOR A REFRIGERATOR APPLIANCE AND A METHOD FOR OPERATING THE SAME

(71) Applicant: General Electric Company, Schenectady, NY (US)

(72) Inventor: Charles Benjamin Miller, Louisville, KY (US)

(73) Assignee: General Electric Company, Schenectady, NY (US)

( * ) Notice: Subject to any disclaimer, the term of this patent is extended or adjusted under 35 U.S.C. 154(b) by 237 days.

(21) Appl. No.: 13/740,541

(22) Filed: Jan. 14, 2013

(65) Prior Publication Data

US 2014/0196479 A1 Jul. 17, 2014

(51) Int. Cl.

| | |
|---|---|
| ***F25C 5/04*** | (2006.01) |
| ***F25C 1/10*** | (2006.01) |
| ***F25C 5/06*** | (2006.01) |

(52) U.S. Cl.

CPC ..... *F25C 5/06* (2013.01); *F25C 2305/022* (2013.01); *F25C 2700/06* (2013.01)

(58) Field of Classification Search

CPC ..... F25C 5/04; F25C 1/10; F25C 5/007; F25C 5/18; F25C 1/12; F25C 5/06; F25C 2305/022; F25C 2700/06

USPC ..... 62/72, 340, 344, 353, 349

See application file for complete search history.

(56) References Cited

U.S. PATENT DOCUMENTS

| | | | | |
|---|---|---|---|---|
| 3,308,631 | A | 3/1967 | Kniffin | |
| 3,962,883 | A * | 6/1976 | Smith | 62/137 |
| 4,002,041 | A * | 1/1977 | Canter | 62/137 |
| 4,142,373 | A * | 3/1979 | Weibel et al. | 62/138 |
| 4,142,378 | A * | 3/1979 | Bright et al. | 62/135 |
| 4,628,698 | A * | 12/1986 | Needham et al. | 62/137 |
| 4,852,359 | A * | 8/1989 | Manzotti | 62/68 |
| 6,282,909 | B1 * | 9/2001 | Newman et al. | 62/74 |
| 6,951,113 | B1 * | 10/2005 | Adamski | 62/3.62 |
| 7,216,491 | B2 * | 5/2007 | Cole et al. | 62/74 |
| 7,475,555 | B2 * | 1/2009 | Janardhanam et al. | 62/89 |
| 7,543,453 | B2 * | 6/2009 | Boarman et al. | 62/98 |
| 8,800,314 | B2 * | 8/2014 | Mitchell | 62/347 |
| 2001/0039804 | A1 * | 11/2001 | Newman et al. | 62/66 |
| 2006/0086135 | A1 * | 4/2006 | Wu et al. | 62/351 |
| 2006/0117784 | A1 * | 6/2006 | Yang | 62/340 |
| 2006/0201170 | A1 * | 9/2006 | Cole | 62/135 |
| 2006/0266066 | A1 * | 11/2006 | Anderson et al. | 62/340 |
| 2006/0266067 | A1 * | 11/2006 | Anderson et al. | 62/340 |
| 2007/0012061 | A1 * | 1/2007 | Ribeiro et al. | 62/344 |
| 2007/0089450 | A1 * | 4/2007 | Janardhanam et al. | 62/340 |
| 2007/0151282 | A1 * | 7/2007 | Jeong et al. | 62/349 |
| 2008/0072610 | A1 * | 3/2008 | Venkatakrishnan et al. | 62/135 |
| 2009/0255282 | A1 * | 10/2009 | Amonett et al. | 62/137 |
| 2010/0043458 | A1 * | 2/2010 | Wu et al. | 62/73 |
| 2010/0043459 | A1 * | 2/2010 | Wu et al. | 62/73 |
| 2010/0218524 | A1 | 9/2010 | Saito | |
| 2010/0326118 | A1 | 12/2010 | Jeong et al. | |
| 2011/0259037 | A1 * | 10/2011 | McCollough et al. | 62/345 |
| 2011/0302950 | A1 * | 12/2011 | Hawkins et al. | 62/344 |
| 2012/0031126 | A1 * | 2/2012 | Zhang et al. | 62/126 |

* cited by examiner

*Primary Examiner* — Mohammad M Ali

(74) *Attorney, Agent, or Firm* — Dority & Manning, P.A.

(57) ABSTRACT

An ice maker for a refrigerator appliance and a method for operating the same are provided. The ice maker includes a mold body that is rotatable relative to an ejector. The ejector is configured for selective receipt within the mold body to assist with removal of ice from the mold body. The ice maker also includes at least two sensors for monitoring rotational motion of the mold body. Utilizing the at least two sensors, the ice maker can monitor ice removal from the mold body.

20 Claims, 9 Drawing Sheets

ICE MAKER FOR A REFRIGERATOR APPLIANCE AND A METHOD FOR OPERATING THE SAME

FIELD OF THE INVENTION

The present subject matter relates generally to ice makers for refrigerator appliances.

BACKGROUND OF THE INVENTION

Certain refrigerator appliances include an ice maker for producing ice. The ice maker can receive liquid water, and such liquid water can freeze within the ice maker to form ice. In particular, certain ice makers include a mold body that defines a plurality of cavities. The plurality of cavities can be filled with liquid water, and such liquid water can freeze within the plurality of cavities to form ice cubes.

During freezing, the ice cubes can adhere or stick to the mold body. Thus, removing the ice cubes from the mold body can be difficult. Ice makers can include various mechanisms for assisting removal of ice cubes from the mold body. Certain ice makers include heaters that heat the mold body. Heating the mold body can slightly melt the ice cubes located therein. With the ice cubes slightly melted, a harvester or rake can scoop out or remove the ice cubes from the mold body. Heaters can reliably assist ice cube removal. However, such heaters can be energy intensive and consume costly electricity.

To conserve electricity, certain ice makers twist the mold body to release ice cubes contained therein. Such ice makers generally include a mold body that can rotate in two opposite directions. When the mold body is rotated in a first direction, the mold body can be twisted, e.g., because one end of the mold body is held fixed. In the second, opposite direction, the mold body can rotate until the mold body is flipped and ice cubes drop out of the mold body. Such ice makers can consume less electricity compared to ice makers that utilize heaters. However, such ice makers have certain drawbacks. In particular, twisting the mold body may not release all ice cubes from the mold body. Thus, when the mold body is flipped, ice cube can remain within the mold body. If ice cubes remain stuck within the mold body, liquid water added to the mold body during subsequent ice making processes can overfill the mold body and negatively affect performance of the ice maker.

Accordingly, an ice maker with features for assisting removal of ice cubes from a mold body of the ice maker would be useful. In particular, an ice maker with features for assisting removal of ice cubes from a mold body of the ice maker after twisting the mold body would be useful.

BRIEF DESCRIPTION OF THE INVENTION

The present subject matter provides an ice maker for a refrigerator appliance and a method for operating the same. The ice maker includes a mold body that is rotatable relative to an ejector. The ejector is configured for selective receipt within the mold body to assist with removal of ice from the mold body. The ice maker also includes at least two sensors for monitoring rotational motion of the mold body. Utilizing the at least two sensors, the ice maker can monitor ice removal from the mold body. Additional aspects and advantages of the invention will be set forth in part in the following description, or may be apparent from the description, or may be learned through practice of the invention.

In a first exemplary embodiment, a method for operating an ice maker of a refrigerator appliance is provided. The ice maker has a mold body that is rotatable relative to an ejector. The ice maker also has at least two sensors for monitoring rotation of the mold body. The method includes determining that the mold body of the ice maker is in a fill position based upon a signal received from a first sensor of the at least two sensors, filling the mold body of the ice maker with liquid water when the mold body is in the fill position, turning the mold body of the ice maker in a first rotational direction from the fill position towards a twist position, and revolving the mold body of the ice maker in a second rotational direction from the twist position towards a harvest position. The second rotational direction is opposite to the first rotational direction.

In a second exemplary embodiment, an ice maker for a refrigerator appliance is provided. The ice maker defines an axial direction and a circumferential direction. The ice maker includes a mold body that defines a plurality of cavities for receipt of liquid water for freezing and a motor in mechanical communication with the mold body. The motor is configured for selectively rotating the mold body about an axis of rotation that is parallel to the axial direction. An ejector is positioned adjacent the mold body and has a plurality of harvesters. Each harvester of the plurality of harvesters is configured for selective receipt within a respective cavity of the plurality of cavities of the mold body. At least two sensors are positioned proximate the mold body. The at least two sensor are spaced apart from each other along the circumferential direction. Each sensor of the at least two sensors is configured for determining that the mold body is in a particular rotational position.

In a third exemplary embodiment, a method for operating an ice maker of a refrigerator appliance is provided. The ice maker has a mold body rotatable relative to an ejector. The ice maker also has at least two sensors for monitoring rotation of the mold body. The method includes determining that the mold body of the ice maker is in a fill position based upon a signal received from a first sensor of the at two sensors, filling the mold body of the ice maker with liquid water when the mold body is in the fill position, revolving the mold body of the ice maker towards a harvest position, and monitoring a second sensor of the at least two sensors in order to determine if the mold body of the ice maker is in the harvest position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
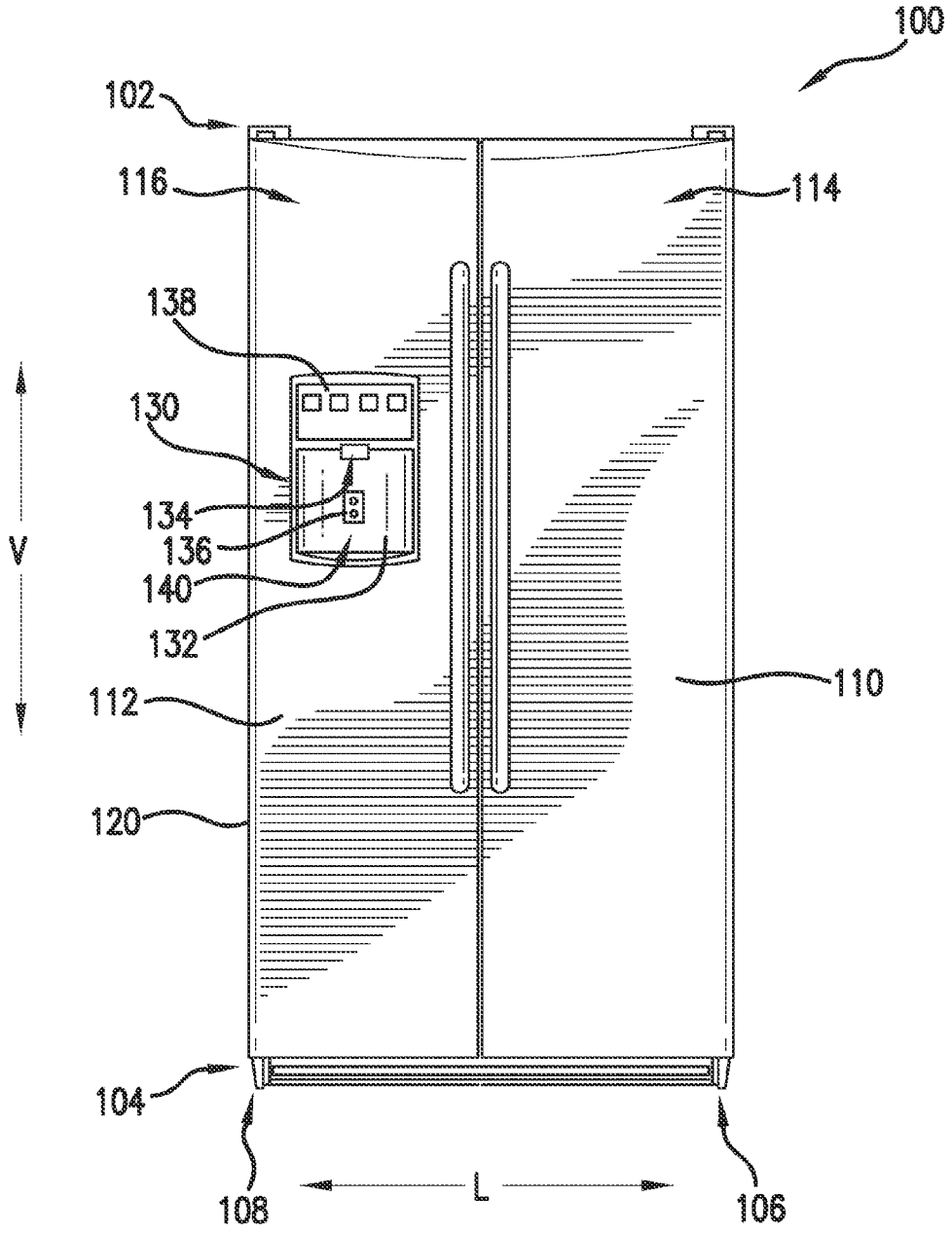
FIG. 1 provides a front, elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
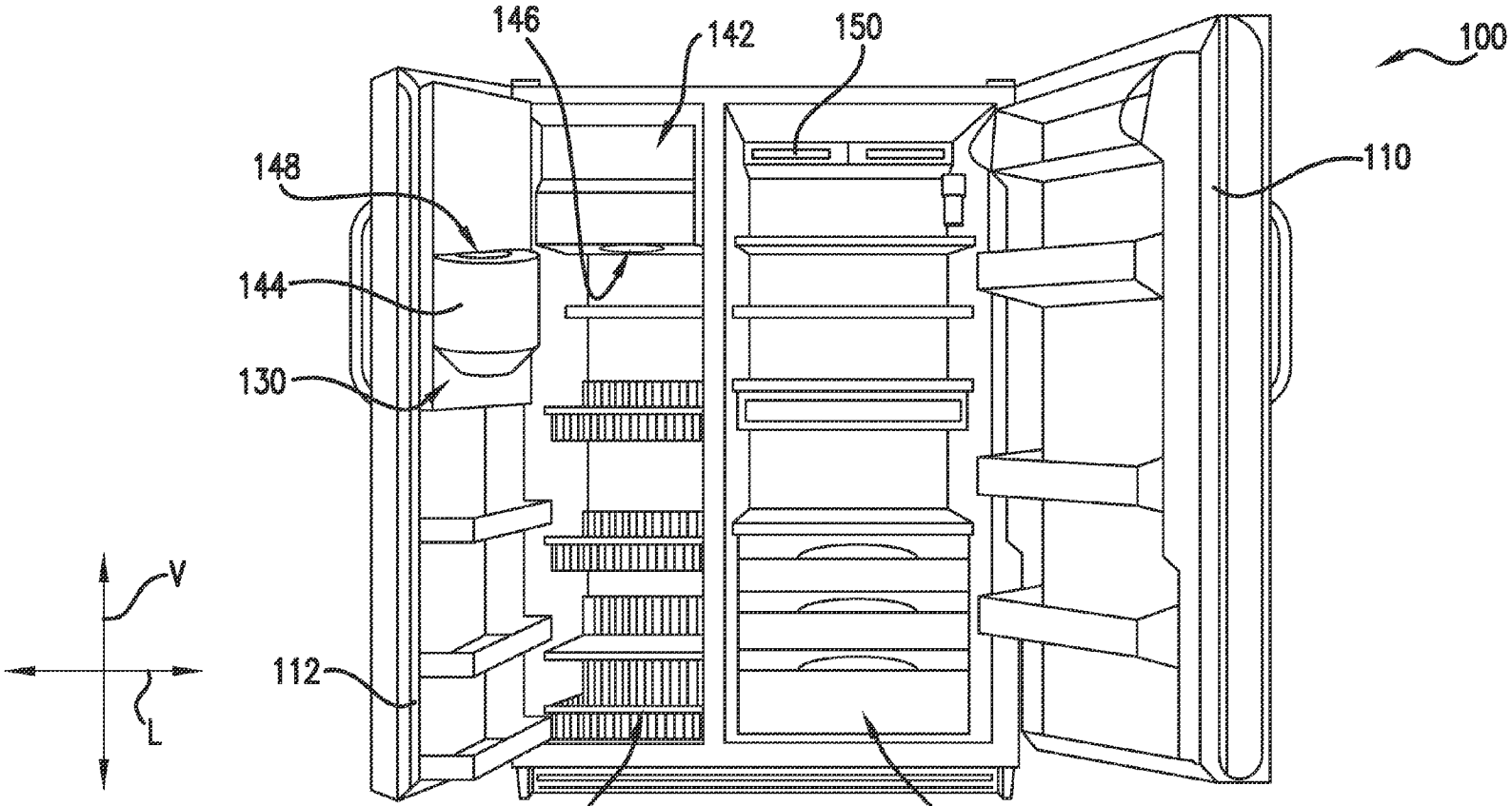
FIG. 2 provides a front, elevation view of the refrigerator appliance of FIG. 1 with a refrigerator door and a freezer door of the refrigerator appliance shown in an open position to reveal a fresh food chamber and a freezer chamber of the refrigerator appliance.

FIG. 1 provides a front, elevation view of a refrigerator appliance 100 according to an exemplary embodiment of the present subject matter. FIG. 2 provides a front, elevation view of refrigerator appliance 100 with a refrigerator door 110 and a freezer door 112 of refrigerator appliance 100 shown in an open position to reveal a fresh food chamber 114 and a freezer chamber 116 of refrigerator appliance 100. Refrigerator appliance 100 defines a vertical direction V, a transverse direction T (FIG. 3), and a lateral direction L. The vertical direction V, transverse direction T, and lateral direction L are mutually perpendicular and form an orthogonal direction system. Refrigerator appliance 100 extends between an upper portion 102 and a lower portion 104 along the vertical direction V. Refrigerator appliance 100 also extends between a first side portion 106 and a second side portion 108, e.g., along the lateral direction L.

Refrigerator appliance 100 includes a cabinet 120 that defines chilled chambers for receipt of food items for storage. In particular, refrigerator appliance 100 defines fresh food chamber 122 at first side portion 106 of refrigerator appliance 100 and a freezer chamber 124 arranged next to fresh food chamber 122 at second side portion 108 of refrigerator appliance 100. As such, refrigerator appliance 100 is generally referred to as a side-by-side style refrigerator appliance. However, using the teachings disclosed herein, one of skill in the art will understand that the present subject matter may be used with other types of refrigerator appliances (e.g., bottom mount or top mount style) or a freezer appliance as well. Consequently, the description set forth herein is for illustrative purposes only and is not intended to limit the present subject matter in any aspect.

Refrigerator door 110 is rotatably hinged to an edge of cabinet 120 for accessing fresh food chamber 114. Similarly, freezer door 112 is rotatably hinged to an edge of cabinet 120 for accessing freezer chamber 116. Refrigerator door 110 and freezer door 112 can rotate between an open position (shown in FIG. 2) and a closed position (shown in FIG. 1) in order to permit selective access to fresh food chamber 114 and freezer chamber 116, respectively.

Refrigerator appliance 100 also includes a dispensing assembly 130 for dispensing water and/or ice. Dispensing assembly 130 includes a dispenser 132 positioned on or mounted to an exterior portion of refrigerator appliance 100, e.g., on freezer door 112. Dispenser 132 includes a discharging outlet 134 for accessing ice and water. Any suitable actuator may be used to operate dispenser 132. For example, dispenser 132 can include a paddle or button for operating dispenser. A sensor 136, such as an ultrasonic sensor, is mounted below discharging outlet 134 for operating dispenser 132, e.g., during an auto-fill process of refrigerator appliance 100. A user interface panel 138 is provided for controlling the mode of operation. For example, user interface panel 138 includes a water dispensing button (not labeled) and an ice-dispensing button (not labeled) for selecting a desired mode of operation such as crushed or non-crushed ice.

Discharging outlet 134 and sensor 136 are an external part of dispenser 130 and are mounted in a dispenser recess 140 defined in an outside surface of freezer door 112. Dispenser recess 140 is positioned at a predetermined elevation convenient for a user to access ice or water and enabling the user to access ice without the need to bend-over and without the need to access freezer chamber 116. In the exemplary embodiment, dispenser recess 140 is positioned at a level that approximates the chest level of a user.

Turning now to FIG. 2, certain components of dispensing assembly 130 are illustrated. Dispensing assembly 130 includes a housing 142 mounted within freezer chamber 116. Housing 142 is constructed and arranged to facilitate production and storage of ice. More particularly, housing 142 contains an ice maker (not shown) for creating ice and feeding the same to a container 144 that is mounted on freezer door 112. As illustrated in FIG. 2, container 144 is placed at a vertical position on freezer door 112 that will allow for the receipt of ice from a discharge opening 146 into an entrance 148 of container 144. As freezer door 112 is closed or opened, container 144 is moved in and out of position under housing 142.

Operation of the refrigerator appliance 100 can be regulated by a controller 150 that is operatively coupled to user interface panel 138 and/or sensor 136. User interface panel 138 provides selections for user manipulation of the operation of refrigerator appliance 100 such as e.g., selections between whole or crushed ice, chilled water, and/or other options as well. In response to user manipulation of the user interface panel 138, controller 150 operates various components of the refrigerator appliance 100. Controller 150 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may be positioned in a variety of locations throughout refrigerator appliance 100. In the illustrated embodiment, controller 150 is located at upper portion 102 or refrigerator appliance 100 within fresh food chamber 114. However, in alternative exemplary embodiments, controller 150 may be located within the control panel area of freezer door 112. Input/output ("I/O") signals may be routed between controller 150 and various operational components of refrigerator appliance 100. For example, user interface panel 138 may be in communication with controller 150 via one or more signal lines or shared communication busses.

Figure 3:
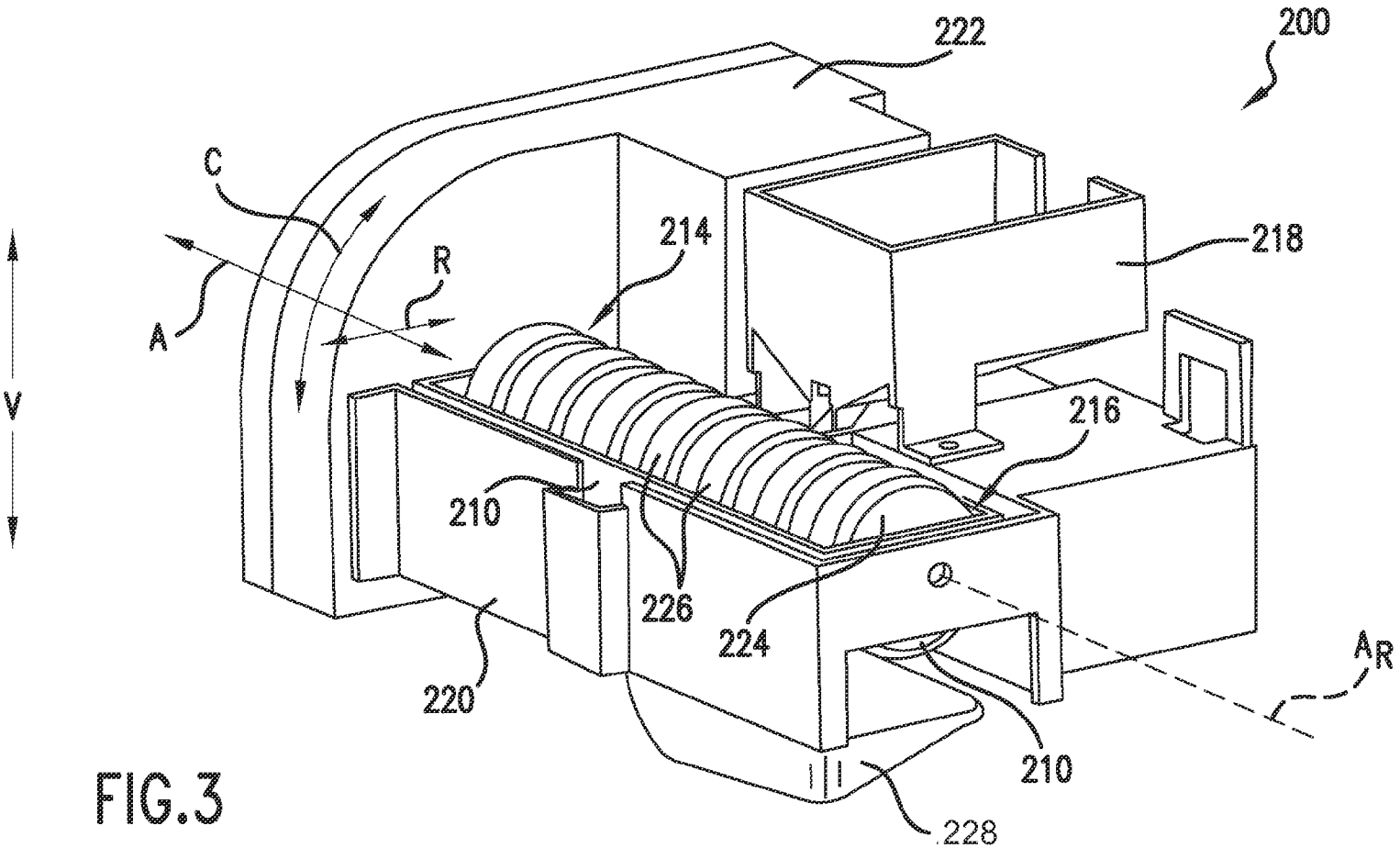
FIG. 3 provides a perspective view of an ice maker according to an exemplary embodiment of the present subject matter.
Figure 4:
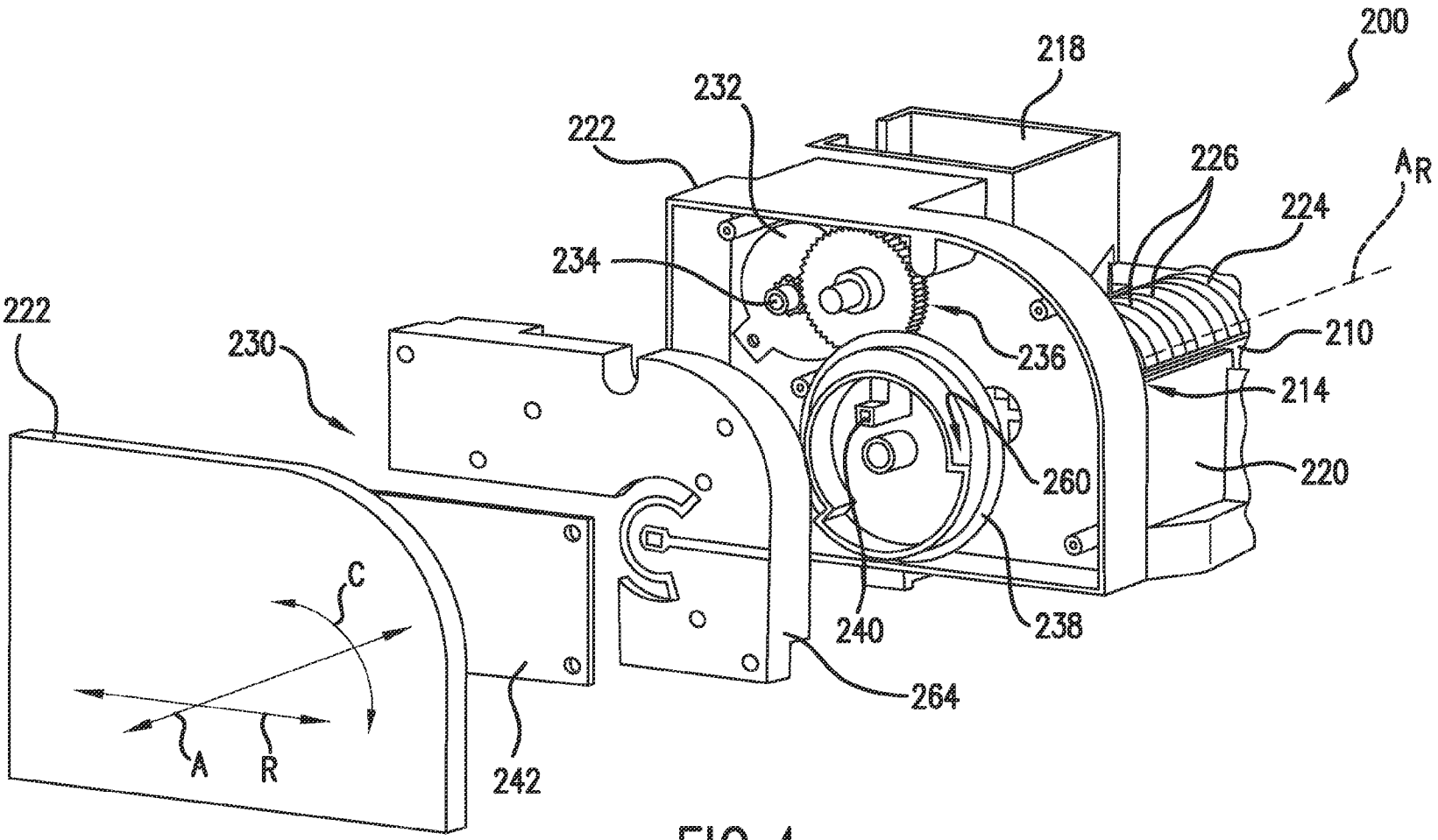
FIG. 4 provides an exploded view of the ice maker of FIG. 3.

FIG. 3 provides a perspective view of an ice maker 200 according to an exemplary embodiment of the present subject matter. FIG. 4 provides an exploded view of ice maker 200. Ice maker 200 is configured for production of ice as discussed in greater detail below. Ice maker 200 may be used within any suitable refrigerator appliance, such as refrigerator appliance 100 (FIG. 1). As an example, ice maker 200 may be positioned within housing 142 of refrigerator appliance 100.

As may be seen in FIGS. 3 and 4, ice maker 200 defines an axial direction A, a circumferential direction C, and a radial direction R. Ice maker 200 also includes a mold body 210 that extends between a first end portion 214 and a second end portion 216, e.g., along the axial direction A. Mold body 210 defines a plurality of cavities 212 (FIG. 8) for receipt of liquid water for freezing. In particular, ice maker 200 includes a water cup 218 that can receive liquid water, e.g., from a water connection to plumbing within a residence or business housing refrigerator appliance 100, and direct such liquid water into mold body, e.g., into cavities 212 of mold body 210. Cavities 212 are spaced apart from one another or distributed, e.g., along the axial direction A between first end portion 214 and second end portion 216.

Within cavities 212 of mold body 210, liquid water received from water cup 218 can freeze to from ice cubes. As will be understood by those skilled in the art, ice cubes within cavities 212 can adhere or stick to mold body 210 and, e.g., hinder removal of such ice cubes from mold body 210. Thus, ice maker 200 includes features for assisting removal of ice cubes from mold body 210 as discussed in greater detail below.

Turning to FIG. 4, ice maker 200 includes a motor 232 positioned within a motor housing 222. Motor 232 is in mechanical communication with mold body 210, e.g., via gearing 236, such that motor 232 can rotate mold body 210. Thus, motor 232 is configured for selectively rotating mold body 210 about an axis of rotation $A_R$, e.g., that is parallel to the axial direction A. As an example, a shaft 234 of motor 232 can rotate in either a first rotational direction or a second, opposite rotational direction, and such rotation can turn gearing 236 that, in turn, rotates mold body 210. In particular, gearing 236 can transfer rotation motion of motor 232 to a cam 238 of mold body 210, e.g., positioned at first end portion 214 of mold body 210.

To loosen ice cubes within cavities 212 from mold body 210, mold body 210 can be twisted. To twist mold body 210, motor 232 can urge first end portion 214 of mold body 210 to rotate. During such rotation of first end portion 214 of mold body 210, second end portion 216 of mold body 210 can remain stationary, fixed, or rotated less than first end portion 214 of mold body 210. In such a manner, mold body 210 can twist and, e.g., loosen or dislodge ice cubes from mold body 210.

Mold body 210 is rotatable relative to an ejector 224. Ejector 224 is positioned adjacent mold body 210 and is configured for assisting with removal of ice from cavities 212 of mold body 210. Ejector 224 is mounted or fixed to a support frame 220. Thus, as motor 232 rotates mold body 210, ejector 224 can remain stationary or fixed and assist with removal of ice from cavities 212 of mold body 210. In particular, ejector 224 has a plurality of harvesters 226, e.g., spaced apart from each other or distributed along the axial direction A. Each harvester of harvesters 226 is configured for selective receipt within a respective cavity of cavities 212. For example, as mold body 210 is rotated by motor 232, harvesters 226 can move or slide into cavities 212 and push or urge ice cubes out of cavities 212.

Figure 5:
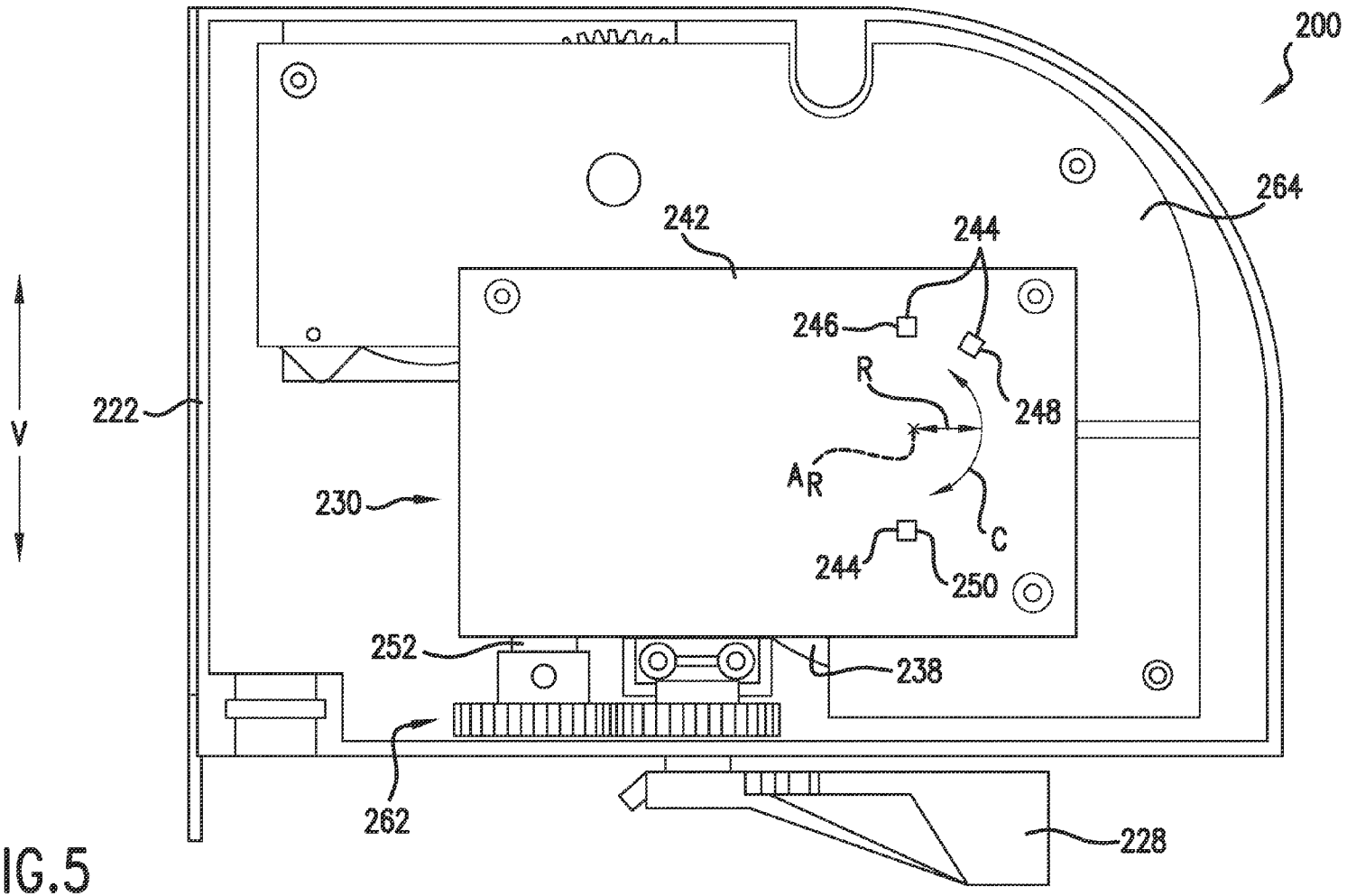
FIGS. 5-7 provide partial section views of the ice maker of FIG. 3 and show a rotational positioning assembly of the ice maker.
Figure 6:
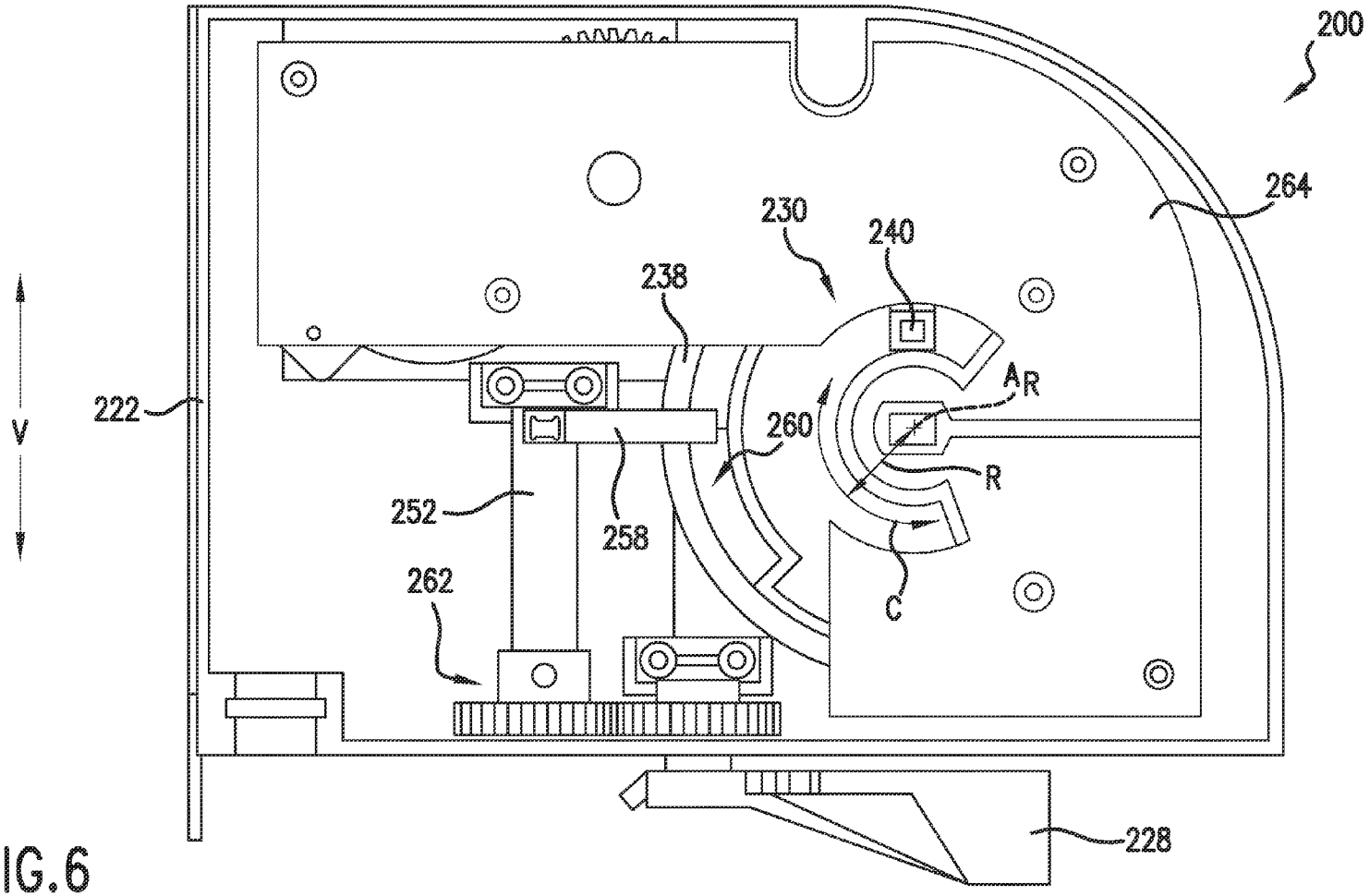
Figure 7:
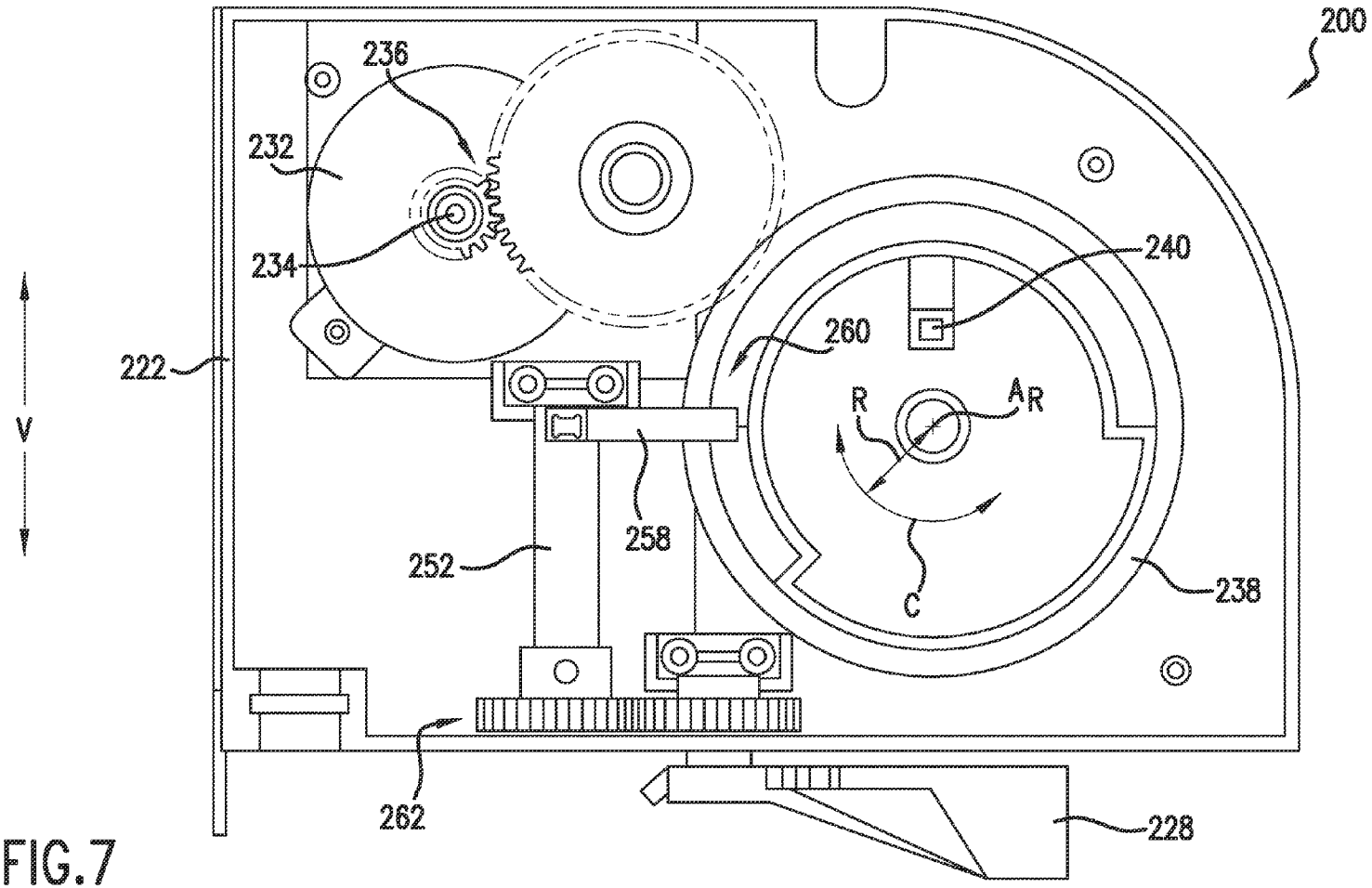

FIGS. 5-7 provide partial section views of ice maker 200 and show a rotational positioning assembly 230 of ice maker 200. Rotational positioning assembly 230 is configured for monitoring rotational motion of mold body 210. Thus, rotational positioning assembly 230 can be used to determine a rotational position of mold body 210 as discussed in greater detail below.

As may be seen in FIG. 5, rotational positioning assembly 230 includes a circuit board 242 mounted to a support plate 264. Circuit board 242 and support plate 264 are positioned within motor housing 222. In particular, support plate 264 is mounted to motor housing 222. Sensors 244 are mounted on circuit board 242. Sensors 244 are configured for determining the rotational position of mold body 210 and may be any suitable sensors for determining the rotational position of mold body 210. For example, sensors 244 may be Hall effect sensors, micro switches, or combinations thereof.

Sensors 244 are positioned proximate mold body 210, e.g., cam 238 of mold body 210. Sensor 244 are spaced apart from each other, e.g., along the circumferential direction C, and spaced apart from the axis of rotation $A_R$, e.g., along the radial direction R. Each sensor of sensors 244 is configured for determining that mold body 210 is in a particular rotational position. Thus, each sensor of sensors 244 can trip or activate when mold body 210 is in an associated rotational position as discussed in greater detail below.

Sensors 244 are mounted to circuit board 242 that can remain stationary relative to mold body 210, e.g., during rotation of mold body 210 by motor 232. Turning to FIG. 7, a mold body activator 240 is mounted to cam 238 of mold body 210 and spaced apart from the axis of rotation $A_R$, e.g., along the radial direction R. During rotation of mold body 210, mold body activator 240 moves, e.g., along the circumferential direction C, between sensors 244. When mold body activator 240 is positioned adjacent or at one of sensors 244, mold body activator 240 can trip or activate the one of sensors 244. Thus, as mold body 210 rotates, mold body activator 240 can trip or actuate any one of sensors 244 depending upon the rotational position of mold body 210.

Mold body activator 240 can be any suitable device for activating or tripping sensors 244. In the exemplary embodiment shown in FIGS. 5-9, mold body activator 240 is a magnet because sensors 244 are Hall effect sensors. However, in alternative exemplary embodiments, mold body activator 240 can be a projection or molded feature of cam 238, e.g., when sensors 244 are micro switches.

Figure 11:
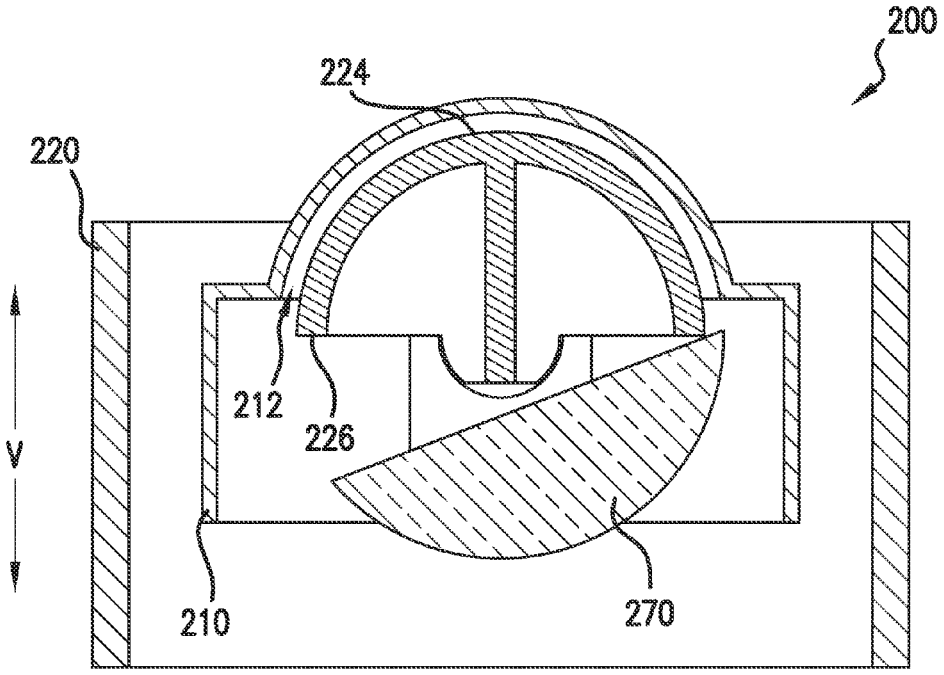

As discussed above, mold body 210 can rotate between various rotation positions. In particular, mold body 210 is rotatable by motor 232 between a fill position (FIG. 8), a twist position (FIG. 9), and a harvest position (FIG. 11). Further, each sensor of sensors 244 is configured for establishing that mold body 210 is in a respective one of the fill position, the twist position, and the harvest position. Specifically, sensors 244 include a first sensor 246, a second sensor 250, and a third sensor 248. First sensor 246 is configured for signaling that mold body 210 is in the fill position. Thus, mold body activator 240 is positioned adjacent or at first sensor 246 when mold body 210 is in the fill position. Similarly, third sensor 248 is configured for signaling that mold body 210 is in the twist position. Thus, mold body activator 240 is positioned adjacent or at third sensor 248 when mold body 210 is in the twist position. In addition, second sensor 250 is configured for signaling that mold body 210 is in the harvest position.

Thus, mold body activator 240 is positioned adjacent or at second sensor 250 when mold body 210 is in the harvest position.

As may be seen in FIG. 5, first and second sensors 246 and 250 are spaced apart from each other along the circumferential direction C. First and second sensors 246 and 250 may be spaced apart from each other along the circumferential direction C by any suitable amount. For example, first and second sensors 246 and 250 may be spaced apart from each other by about one-hundred and eighty degrees along the circumferential direction C.

Similarly, first and third sensors 246 and 248 are also spaced apart from each other along the circumferential direction C. First and third sensors 246 and 248 may be spaced apart from each other along the circumferential direction C by any suitable amount. For example, first and third sensors 246 and 248 may be spaced apart from each other by about twenty degrees, about thirty degrees, or about forty degrees along the circumferential direction C.

Ice maker 200 also includes a feeler arm 228. Feeler arm 228 is configured for detecting or determining an amount of ice produced by ice maker 200. For example, feeler arm 228 is in mechanical communication with motor 232 via a feeler arm pivot 252 that engages cam 238 of mold body 210. In particular, as cam 238 rotates, an extension arm 258 of feeler arm pivot 252 can ride or slide on a sloped surface 260 of cam 238, e.g., such that feeler arm pivot 252 rotates. In turn, rotational motion of feeler arm pivot 252 is transferred to feeler arm 228, e.g., via a gear arrangement 262. As feeler arm 228 rotates beneath ice maker 200, feeler arm 228 can detect or determine the amount of ice produced by ice maker 200. For example, during rotation of feeler arm 228, if feeler arm impacts ice then ice maker 200 need not produce additional ice because a sufficient supply of ice is available.

FIGS. 8-11 provide partial section views ice maker 200 and show mold body 210 of ice maker 200 in various rotational positions. In particular, mold body 210 is in the fill position in FIG. 8, mold body 210 is in the twist position in FIG. 9, and mold body 210 is in the harvest position in FIG. 11. FIGS. 8-11 also illustrate ice cubes 270 being harvested from mold body 210 of ice maker 200 as discussed in greater detail below.

Ice maker 200 includes a controller, such as controller 150 (FIG. 2), for operating various components of ice maker 200. Thus, the controller is in operative communication with various components of ice maker 200, such as motor 232 and sensors 244. The controller can be programmed to operate ice maker 200 in order to produce and harvest ice therefrom.

Figure 8:
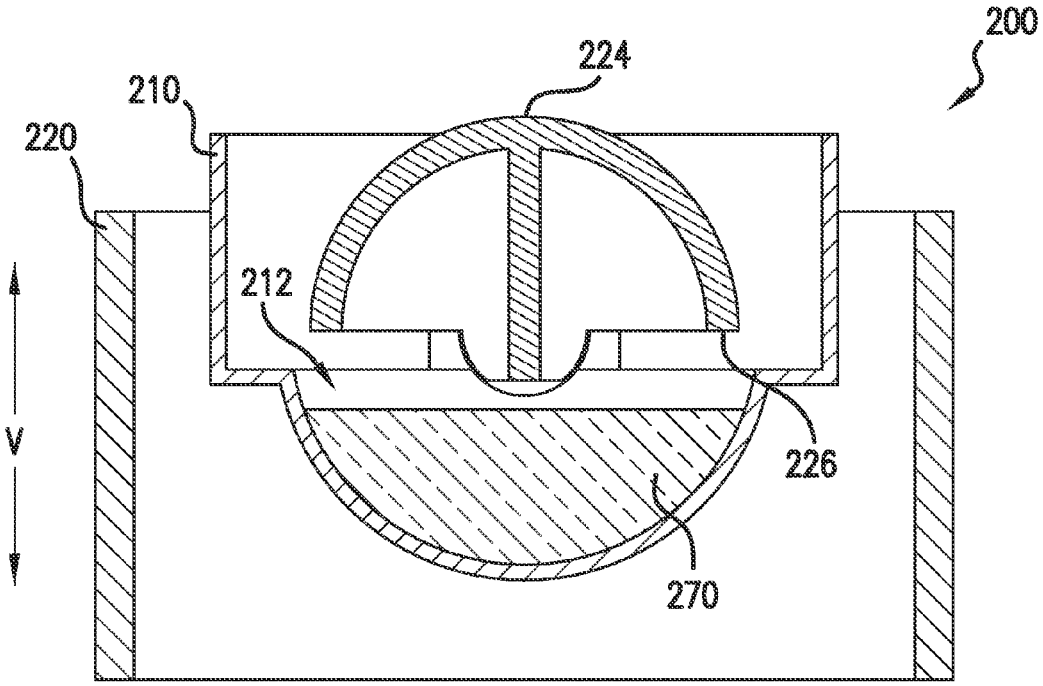
FIGS. 8-11 provide partial section views the ice maker of FIG. 3 and show a mold body of the ice maker in various rotational positions during a harvest sequence of the ice maker.

As an example, the controller can be programmed to determine that mold body 210 is in the fill position shown in FIG. 8. In particular, the controller can receive a signal from first sensor 246 (FIG. 5) when mold body activator 240 is positioned adjacent first sensor 246. Based upon the signal from first sensor 246, the controller can determine that mold body 210 is in the fill position.

In the fill position, ejector 224 is positioned above, e.g., along the vertical direction V, mold body 210, and cavities 212 of mold body 210 are ready for receiving liquid water for freezing. Thus, liquid water from water cup 218 (FIG. 3) can be directed into cavities 212 of mold body 210 in the fill position. With ice maker 200 positioned in a suitably cool location, water within cavities 212 will freeze and form ice cubes 270. The controller can monitor or measure a temperature of mold body 210 via a temperature sensor 280 mounted to mold body 210. When the temperature of mold body 210 drops below the freezing point of water within mold body 210, it can be inferred that ice cubes 270 are fully frozen within mold body 210. As discussed above, ice cubes 270 can stick or adhere to mold body 210, and mold body 210 can be twisted to release ice cubes 270 from mold body.

Figure 9:
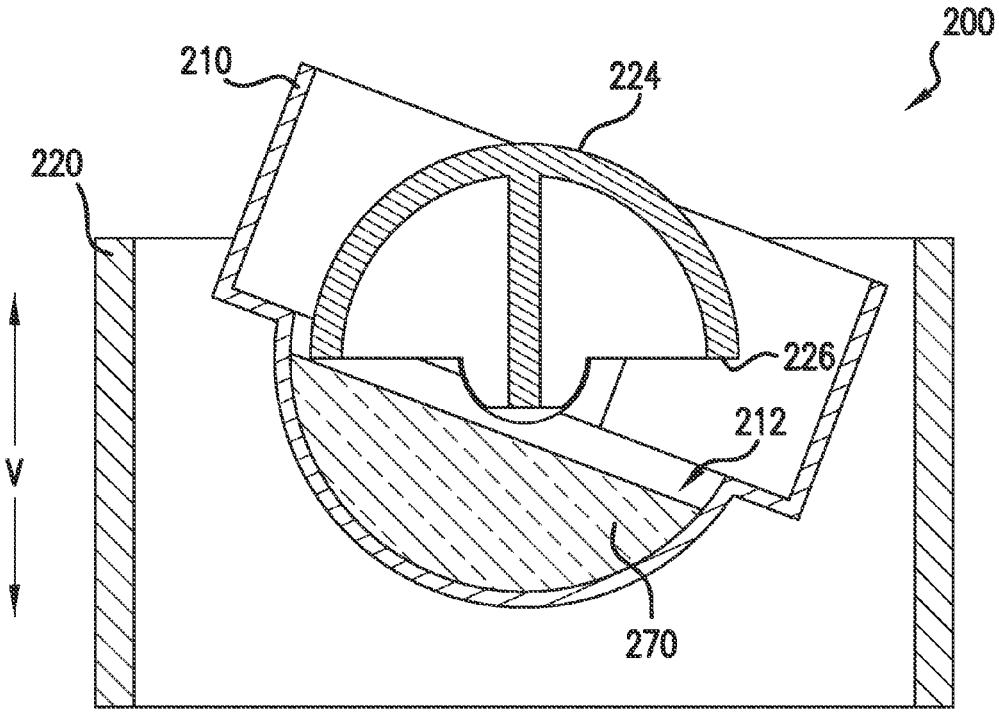

Thus, the controller can activate motor 232 to turn mold body 210 in a first rotational direction from the fill position shown in FIG. 8 towards the twist position shown in FIG. 9. In the twist position, first end portion 214 (FIG. 3) is oriented as shown in FIG. 9. Conversely, second end portion 216 (FIG. 3) is hindered from rotating in first rotational direction to such an orientation and can remain in the orientation shown in FIG. 8. In such a manner, mold body 210 is twisted or warped in the twist position to assist with releasing ice cubes 270 from mold body 210. After ice cubes 270 are released from mold body 210, ice cubes 270 can be more easily removed from cavities 212.

The controller can establish that mold body 210 is in the twist position, e.g., to confirm that mold body 210 has twisted or warped. In particular, the controller can receive a signal from third sensor 248 (FIG. 5) when mold body activator 240 is positioned adjacent third sensor 248. Based upon the signal from third sensor 248, the controller can determine that mold body 210 is in the twist position. In alternative exemplary embodiments, the controller can activate motor 232 to rotate mold body 210 at a known angular velocity for a predetermined period of time in order to establish that mold body 210 is in the twist position. In other alternative exemplary embodiments, the controller can activate motor 232 to rotate mold body 210 until mold body activator 240 impacts support plate 264 in order to establish that mold body 210 is in the twist position.

Figure 10:
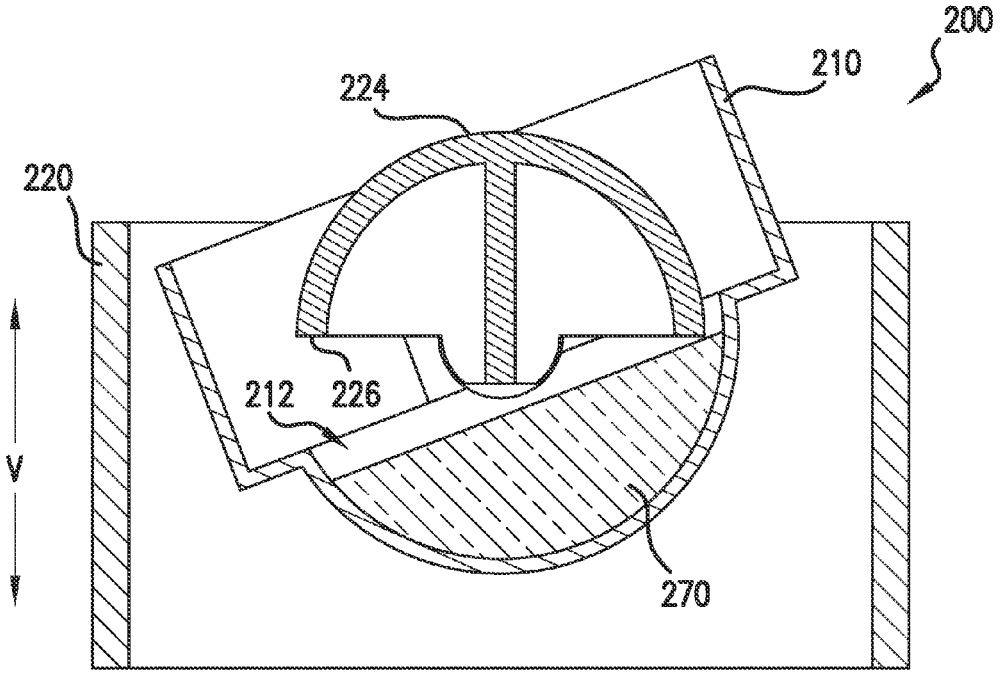

The controller can also drive motor 232 in order to revolve mold body 210 in a second, opposite rotational direction from the twist position shown in FIG. 9 towards the harvest position shown in FIG. 11. In the harvest position, ice cubes 270 can drop or be removed from cavities 212 of mold body 210. In particular, as shown in FIG. 10, ejector 224 enters cavities 212 and engages ice cubes 270 as motor 232 rotates mold body 210 from the twist position to the harvest position. As discussed above, ejector 224 can remain stationary relative to mold body 210 when mold body 210 rotates. Thus, as mold body 210 rotates, ice cubes 270 can be pushed out of mold body 210 by ejector 224.

The controller can also monitor second sensor 250 (FIG. 5) in order to determine if mold body 210 is in the harvest position. As will be understood by those skilled in the art, twisting mold body 210 in the twist position may not fully release all ice cubes 270 from mold body 210 in one attempt. Thus, when the controller drives motor 232 to revolve mold body 210 from the twist position shown to the harvest position, the controller monitors second sensor 250 to determine if mold body 210 is in the harvest position.

As an example, when mold body 210 is in the harvest position, ejector 224 is received within cavities 212 of mold body 210. Thus, it can be inferred that no, e.g., whole, ice cubes remain within mold body 210 when mold body 210 is in the harvest position. Conversely, if the controller drives motor 232 to revolve mold body 210 from the twist position to the harvest position and second sensor 250 does not detect mold body 210 in the harvest position, it can be inferred that ice cubes 270 are stuck within mold body 210 and are hindering rotation of mold body 210.

The controller can monitor second sensor 250 for a predetermined period of time during revolving of mold body 210 from the twist position to the harvest position discussed above. After the predetermined period of time has elapsed, it can be inferred that ice cubes 270 are stuck within mold body 210 and are hindering rotation of mold body 210 and that additional actions are required to harvest ice cubes 270. The predetermined period of time can be any suitable time interval. For example, the predetermined period of time can be greater than about ten seconds, greater than about twenty seconds, or greater than about thirty seconds.

If ice cubes 270 are stuck within mold body 210 despite a first attempt to release ice cubes 270 by twisting mold body 210 in the twist position, the controller can be programmed to twist mold body 210 again by repositioning mold body 210 in the twist position. Thus, the controller can run motor 232 in order to rotate mold body 210 back in the first rotational direction towards the twist position if second sensor 250 does not signal that mold body 210 is in the harvest position after the predetermined period of time has elapsed.

The controller can repeatedly twist mold body 210 and attempt to revolve mold body 210 to the harvest position until second sensor 250 signals that mold body 210 is in the harvest position. In particular, the controller can receive a signal from second sensor 250 when mold body activator 240 is positioned adjacent second sensor 250. Based upon the signal from second sensor 250, the controller can determine that mold body 210 is in the harvest position and that all ice cubes 270 have been removed from mold body 210, e.g., by ejector 224.

As discussed above, with mold body 210 in the harvest position, ejector 224 is received within mold body 210, and ice cubes 270 are removed from cavities 212. Thus, ice maker 200 is configured for operating in order to insure that ice cubes are removed from mold body 210, e.g., prior to a subsequent ice making process of ice maker 210 where liquid water is directed into mold body 210 and any ice cubes 270 remaining within mold body 210 would interfere with such operation by potentially causing mold body 210 to overflow.

It should be understood by those skilled in the art that when mold body 210 is rotated towards the twist position, mold body 210 can be twisted more than once before attempting to remove ice cubes 270 from mold body 210 by flipping mold body 210 to the harvest position. In particular, mold body 210 could be twisted two, three, four, or more times before rotating mold body 210 towards the harvest position. In additional exemplary embodiments, ice maker 200 could be equipped with other suitable mechanisms for releasing ice cubes 270 from mold body 210. Such mechanisms could be used in lieu of or in combination with twisting of mold body 210.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating an ice maker of a refrigerator appliance, the ice
- maker having a mold body rotatable relative to an ejector between a fill position, a twist position, and a harvest position, the ice maker also
- having at least three sensors for monitoring rotation of the mold body, each sensor of said at least three sensors configured for establishing that said mold body is in a respective one of the fill position, the twist position, and the harvest position, the
- method comprising: determining that the mold body of the ice maker is in a fill position based upon a signal received from a first sensor of the at least three sensors; filling the mold body of the ice maker with liquid water when the mold body is in the fill position; turning the mold body of the ice maker in a first rotational direction from the fill position towards a twist position; and revolving the mold body of the ice maker in a second rotational direction from the twist position towards a harvest position, the second rotational direction being opposite to the first rotational direction.

2. The method of claim 1, further comprising monitoring a second sensor of the at least three sensors in order to determine if the mold body of the ice maker is in the harvest position.

3. The method of claim 1, wherein said step of monitoring further comprises monitoring the second sensor for a predetermined period of time.

4. The method of claim 2, wherein the predetermined period of time is more than about ten seconds.

5. The method of claim 2, further comprising rotating the mold body of the ice maker in the first rotational direction to the twist position if the second sensor does not signal that the mold body of the ice maker is in the harvest position after the predetermined period of time has elapsed.

6. The method of claim 5, repeating said steps of revolving, monitoring, and rotating until the mold body of the ice maker is in the harvest position.

7. The method of claim 6, wherein no ice cubes remain within the mold body of the ice maker immediately after said steps of revolving, monitoring, and rotating.

8. The method of claim 1, wherein the ejector of the ice maker is at least partially received within the mold body of the ice maker in the harvest position.

9. The method of claim 1, wherein the ejector of the ice maker is positioned outside of the mold body of the ice maker in the fill position.

10. An ice maker for a refrigerator appliance, the ice maker defining an axial
- direction and a circumferential direction, the ice maker comprising: a mold
- body defining a plurality of cavities for receipt of liquid water for freezing;
- a motor in mechanical communication with said mold body, said motor configured
- for selectively rotating said mold body about an axis of rotation that is
- parallel to the axial direction, said mold body rotatable by said motor between a fill position, a twist position, and a harvest position; an ejector positioned adjacent said mold
- body, said ejector having a plurality of harvesters, each harvester of the plurality of harvesters configured for selective receipt within a respective cavity of the plurality of cavities of said mold body; and at least three sensors positioned proximate said mold body, said at least three sensors spaced apart from each other along the circumferential direction, each sensor of said at least three sensors configured for determining that said mold body is in a
- particular rotational position, each sensor of said at least three sensors configured for establishing that said mold body is in a respective one of the fill position, the twist position, and the harvest position.

11. The ice maker of claim 10, further comprising a controller in operative communication with said motor and said at least three sensors, said controller configured for:

determining that said mold body is in a fill position based upon a signal received from a first sensor of said at least three sensors;

activating said motor to move said mold body and release ice from the plurality of cavities of said mold body; and driving said motor to revolve said mold body towards a harvest position.

12. The ice maker of claim 11, wherein said controller is further configured for monitoring a second sensor of said at least three sensors in order to determine if said mold body is in the harvest position.

13. The ice maker of claim 12, wherein the second sensor of said at least three sensors is monitored for a predetermined period of time during said step of monitoring.

14. The ice maker of claim 13, wherein said controller is further configured for running said motor to rotate said mold body back in the first rotational direction towards the fill position if the second sensor of said at least three sensors does not signal that said mold body is in the harvest position after the predetermined period of time has elapsed.

15. The ice maker of claim 10, wherein said at least three sensors comprises a first sensor and a second sensor, the first and second sensors spaced apart from each other by about one-hundred and eighty degrees along the circumferential direction.

16. The ice maker of claim 10, wherein said mold body is rotatable by said motor between a fill position, a twist position, and a harvest position, each sensor of said at least three sensors configured for establishing that said mold body is in a respective one of the fill position, the twist position, and the harvest position.

17. The ice maker of claim 16, wherein said mold body extends between a first end portion and a second end portion along the axial direction, the first end portion of said mold body rotatable in a first rotational direction and a second rotational direction in the harvest position, the second end portion of said mold body rotatable in the second rotational direction and hindered from rotating in the first rotational direction in the harvest position, the first and second rotational directions being opposite to each other.

18. The ice maker of claim 16, wherein the ice maker defines a vertical direction that is perpendicular to the axial direction, said ejector positioned above said mold body along the vertical direction when said mold body is in the fill position.

19. The ice maker of claim 16, wherein the harvesters of said ejector are at least partially received within the cavities of said mold body when said mold body is in the harvest position.

20. A method for operating an ice maker of a refrigerator appliance, the ice maker having a mold body rotatable relative to an ejector, the ice maker also having at least three sensors for monitoring rotation of the mold body, each sensor of said at least three sensors configured for establishing that said mold body is in a respective one of the fill position, the twist position, and the harvest position, the method comprising: determining that the mold body of the ice maker is in a fill position based upon a signal received from a first sensor of the at least three sensors; filling the mold body of the ice maker with liquid water when the mold body is in the fill position; revolving the mold body of the ice maker towards a harvest position; and monitoring a second sensor of the at least thee sensors in order to determine if the mold body of the ice maker is in the harvest position.

* * * * *